United States Patent [19]

Thompson et al.

[11] Patent Number: 4,486,121

[45] Date of Patent: Dec. 4, 1984

[54] STABILIZATION AGAINST WATER EROSION

[75] Inventors: Wayne L. Thompson, Cypress; Bert E. Bailey, Houston, both of Tex.

[73] Assignee: Ercon Corporation, Houston, Tex.

[21] Appl. No.: 368,878

[22] Filed: Apr. 15, 1982

[51] Int. Cl.[3] ..... E02B 3/12

[52] U.S. Cl. ..... 405/17; 405/18; 405/20

[58] Field of Search ..... 405/15, 16, 17, 18, 405/19, 20, 32, 33

[56] References Cited

U.S. PATENT DOCUMENTS

| | | | |
|---|---|---|---|
| 1,777,926 | 10/1930 | Lilard . | |
| 1,993,217 | 3/1935 | Mason | 61/37 |
| 2,095,989 | 10/1937 | Lilard | 72/101 |
| 2,301,592 | 11/1942 | Teuber | 61/37 |
| 3,344,609 | 10/1967 | Greiser | 61/38 |
| 3,374,635 | 3/1968 | Crandall | 61/38 |
| 3,486,341 | 12/1969 | Huesker-Stiewe et al. | 405/18 |
| 3,524,320 | 8/1970 | Turzillo | 61/38 |
| 3,570,254 | 3/1971 | Turzillo | 61/38 |
| 3,722,222 | 3/1973 | Rinkel | 61/38 |
| 3,886,751 | 6/1975 | Labora | 61/3 |
| 3,922,832 | 12/1975 | Dicker | 52/742 |
| 3,957,098 | 5/1976 | Hepworth | 150/9 |
| 4,090,337 | 5/1978 | Szekeres | 405/19 X |

*Primary Examiner*—David H. Corbin

*Attorney, Agent, or Firm*—Arnold, White & Durkee

[57] ABSTRACT

A structure for protecting a bank against erosion, the structure including a plurality of sacks of cementitious material which are positioned in side-by-side relationship to form a protective skirt; and a plurality of staples having arms which are impaled into adjacent sacks to connect them together, the staples being resiliently deformable for the protective skirt to be capable of articulation for accommodating ground movement and scouring.

12 Claims, 4 Drawing Figures

STABILIZATION AGAINST WATER EROSION

This invention relates to stabilization against water erosion. More particularly, this invention relates to a protection system, a structure and a method of protecting against water erosion.

This invention may have application in regard to bulkhead embankment or revetment structures along river banks, lake banks, shores, seawalls and the like. The invention can further have application in regard to other walls or embankment structures such as highway head walls etc.

Embankment or revetment structures are frequently made of rigid materials which are not capable of yielding. These structures invariably crack due to earth movement thereby leading to progressive failure.

Embankment, bulkhead or revetment structures often fail because of underscouring which occurs at the base of the structure. It is difficult to determine in advance to what extent erosion or undercutting will occur. This can only be determined once the bulkhead or revetment structure has been built. It is therefore difficult to assess to what extent the foot of a bulkhead or other revetment structure should be submerged to prevent significant undercutting. For this reason, attempts have been made to overcome the problem of undercutting or underscouring by utilizing flexible aprons or skirts which are located at the foot of such bulkheads or revetment structures. These flexible aprons or skirts are designed to flex during use to accommodate undercutting and thus follow the contours of the bed on which they rest.

Flexible aprons have been made out of concrete slabs which are connected together by means of cables, rings or clips. These slabs do, however, require special reinforcing rods which extend through the slabs and which have eyes projecting beyond the edges of the slabs so that these eyes may be engaged by the cables, rings or clips to connect the slabs together. This system requires prefabrication of specialized slabs and the use of a different flexible materials to connect the slabs together. It is therefore a costly procedure to manufacture the slabs, and a labor intensive procedure to connect them together.

It is an object of this invention to provide a means of overcoming or reducing some of the disadvantages presented by the prior art.

In accordance with one aspect of this invention, there is provided a protection system for protecting the base of a bank structure against underscouring by water action, the system comprising: (a) a plurality of sacks of cementitious material to be laid along a bed adjacent the bank structure for hydration in situ to form a protective apron; (b) a plurality of staples having arms to be impaled into adjacent sacks for connecting them together, the staples being resiliently deformable to provide for articulation of the apron to accommodate undercutting during use.

The staples are preferably ribbed staples to provide resistance to withdrawal of the arms of the staples after hydration of the cementitious material. These staples therefore preferably have annular ribs at axially spaced interval or helically extending ribs. Where the staples have annular ribs which are axially spaced, the ribs may be tapered to facilitate insertion of the arms of the staple but provide increased resistance to withdrawal.

The staples may be resiliently deformable to be capable of deformation under the weight of one of the sacks when unsupported for allowing a formed apron to follow the contours of the bed on which it rests. If desired, however, the staples may be more rigid so that they will only resiliently yield under the weight of several sacks thereby making the apron slightly more rigid.

The staples may be of a synthetic plastics material, of fiber glass, of steel or of any suitable metal alloy.

In accordance with a further aspect of the invention, there is provided a structure for protecting a bank against erosion, the structure comprising: (a) a plurality of sacks of cementitious material which are positioned in side-by-side relationship to form a protective skirt; and (b) a plurality of staples having arms which are impaled into adjacent sacks to connect them together, the staples being resiliently deformable for the protective skirt to be capable of articulation for accommodating ground movement and/or scouring.

In an embodiment of the invention, the protective skirt may be a skirt which extends generally transversely to the horizontal, and which is built up against the bank to constitute a bulkhead, an embankment, a revetment structure or a retaining wall.

In an alternative embodiment of the invention, the protective skirt may be a skirt which extends generally horizontally or generally transversely to the vertical from a bank structure to protect a bed surface adjacent the toe of the bank structure.

In this embodiment of the invention the structure may include a bank structure built up of a plurality of sacks of cementitious material. The sacks of the bank structure may preferably be pinned together by means of resiliently flexible stakes to allow movement of the structure in response to ground movement. The stakes may be of steel, of a suitable metal alloy or of a synthetic plastics material.

The skirt may conveniently be connected to the base region of the bank structure by means of the staples.

In a preferred embodiment of the invention, the staples are used in an upside down configuration with the arms of the staples extending upwardly into the sacks.

The invention further extends to a method of forming a protective apron for protecting a surface against water erosion, the method comprising: (a) laying a plurality of sacks of cementitious material in side-by-side relationship over the surface to be protected; (b) connecting adjacent sacks together by impaling them with the arms of resiliently deformable staples, the staples being resiliently deformable to allow the protective apron to move to accommodate ground movement; (c) allowing the sacks to become hydrated to cause the cementitious material to set and to bind the arms of the staples in position in the sacks.

Embodiments of the invention are now described by way of example with reference to the accompanying drawings.

Figure 1:
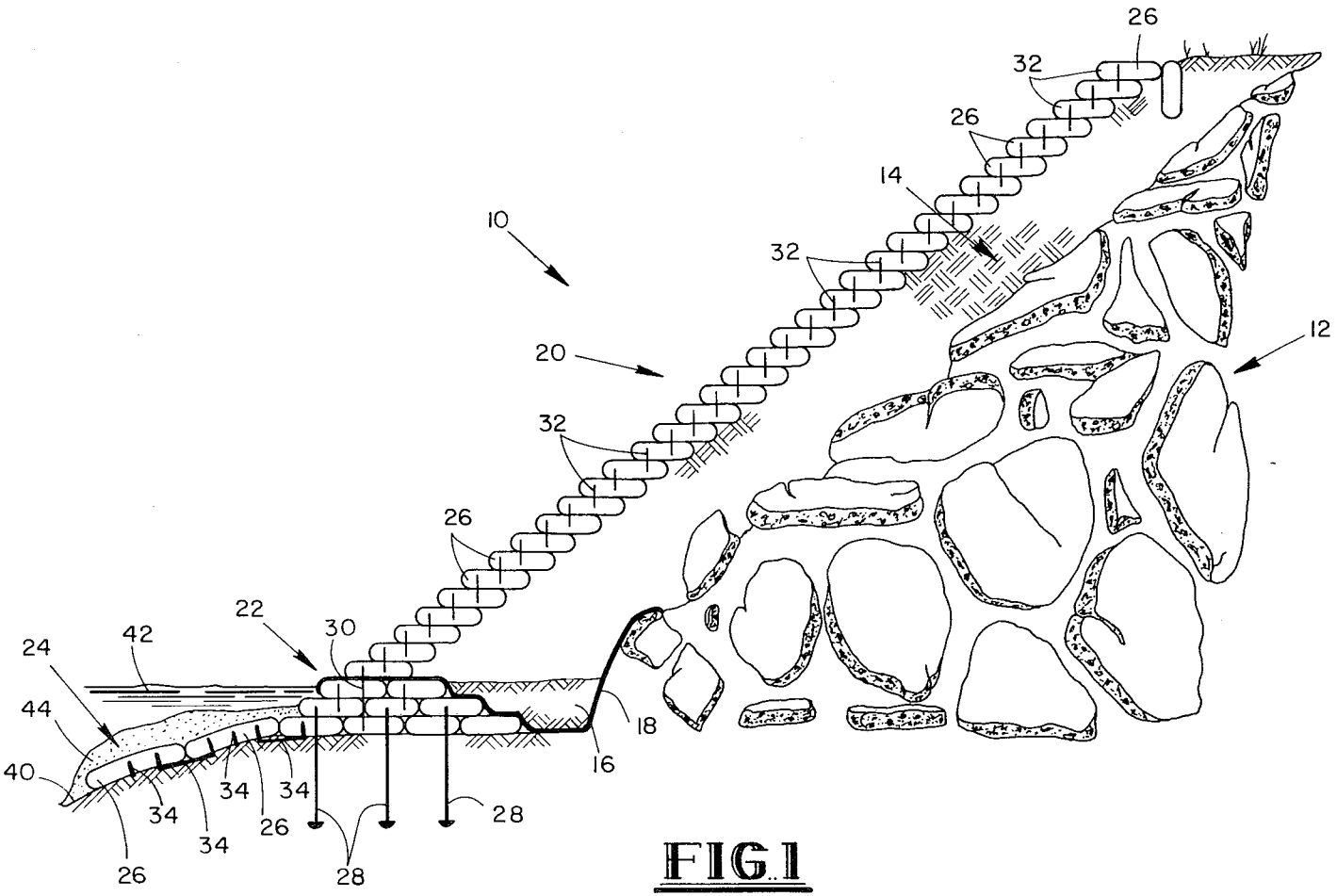
FIG. 1 shows a typical section through an armoured bank armoured in accordance with this invention.

With reference to the drawings, reference numeral 10 refers generally to a revetment structure for controlling erosion along a bank at the shoreline of an ocean or lake, or along the bank of a river.

The bank is formed out of broken backfill and the like indicated generally by reference numeral 12.

The broken backfill 12 is coated with a layer of compacted backfill 14.

The compacted backfill 14 rests on a compacted base material 16. The compacted base material 16 rests on an engineering fabric 18 which extends through the structure of this invention.

The structure 10 comprises a bulkhead section 20, a foot section 22 and a skirt or apron section 24.

Each of the sections 20, 22 and 24 is formed out of sacks or bags 26 of cementitious material which are laid in their appropriate positions while the cementitious material is dry. Hydration of the sacks 26 after laying thus causes the cementitious material to set in situ.

The sacks 26 may be of any appropriate size for the intended application. In a preferred embodiment of the invention each sack or bag 26 has a length of about 21 inches, a width of about 13 inches, and a thickness of about $4\frac{3}{4}$ inches.

The foot section 22 is first constructed by laying the sacks 26 in staggered relationship, and by fixing the stacks in position by means of $2\frac{1}{2}$ feet long No. 8 rebar pins 28 which are hammered through the lowermost two layers of sacks 26 into the ground.

Eighteen inch No. 6 rebar pins 30 are used for securing several of the layers of sacks 26 in the foot section 22 together. In addition, 9-inch long No. 4 rebar pins 32 are used for securing adjacent layers of sacks 26 together.

Once the foot section 22 has been formed, the bulkhead section 20 is formed by stacking the sacks 26 in staggered relationship on top of each other, and fixing adjacent layers together by means of the pins 32.

The pins 32 are of $\frac{1}{4}$ inch diameter steel and are thus able to yield resiliently before the concrete in the sacks 26 cracks or permits withdrawal of the pins 32 after it has set. The structure is therefore resiliently flexible and can yield to accommodate earth movements.

The pins 32 are chosen so that they will commence yielding at a yield point at least about 10% to 20% lower than the yield point of the concrete of the sacks 26.

Figure 3:
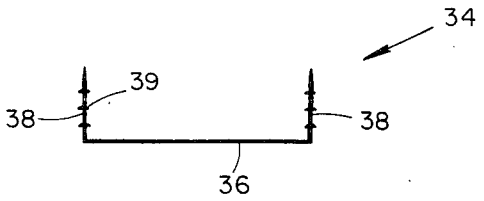
FIG. 3 shows, to an enlarged scale, an elevation of a staple as utilized in FIGS. 1 and 2.
Figure 4:
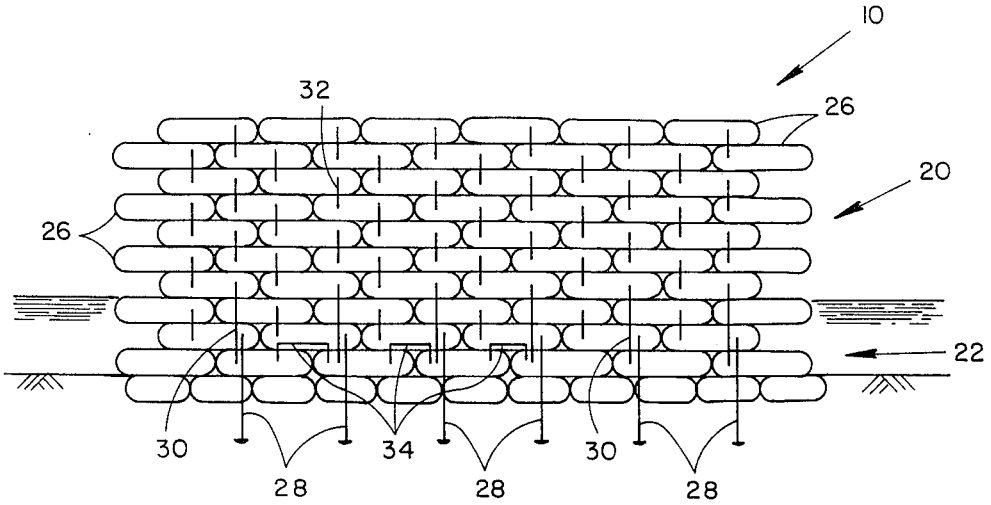
FIG. 4 shows a schematic front elevation of portion of the embankment or revetment structure of FIGS. 1 and 2.

The sacks 26 of the foot section 22 and bulkhead section 20 may also be connected together by means of staples 34 as shown in FIG. 3. In this event the staples 34 would be utilized to secure adjacent sacks 26 in each layer to each other to form a laterally contiguous bulkhead and foot section as shown in FIG. 4.

Each staple 34 has a base portion 36 and two arms 38 which extend from the base portion 36. Ribs 39 are formed on arms 38 of each staple 34.

Each arm 38 is ribbed to provide increased resistance for an arm 38 from pulling out of a sack 26 once the concrete therein has set.

Each base portion 36 has a length of about 12 inches, whereas each arm 38 has a length of about 3 inches. Each staple 34 is formed out of steel having a $\frac{1}{4}$ inch diameter. Each staple 34 will therefore be capable of resiliently yielding if the sacks 26 to which it is connected shift, before the concrete in the sacks 26 will crack.

The skirt or apron section 24 of the structure 10 is formed by laying the sacks 26 along the bed surface 40 which is below the water level 42.

The sacks 26 in the toe or apron section 24 are laid to extend lengthwise away from the foot section 22. The sacks 26 in the apron section 24 are laid in two rows which extend parallel to the foot section 22. They may, however, be laid in any number of rows as may be required by bed and water conditions.

The sacks 26 in each of the rows are connected together by means of the staples 34, while the uppermost of the two rows is connected to the foot section 22 by means of staples 34.

In the embodiment illustrated in FIG. 1 of the drawings, the staples 34 are used in upside down orientation. In addition, the sacks 26 in each row are connected together by means of staples 34 which are again used in an inverted orientation.

For laying the apron section 24, one arm 38 of a staple 34 will be inserted into the sack 26 which is to be laid in the foot section 22 nearest to the water. This sack 26 will then be inverted and laid. A sack for the apron section 24 will then be taken and one arm 38 of two separate staples 34 will be impaled into that sack so that the base portion 26 of the one staple 34 extends at right angles to the base portion 36 of the remaining staple 34. That sack will then be turned over and impaled onto the remaining arm 38 of the staple 34 which is already impaled into the sack 26 laid in the foot section 22. This will leave two upwardly extending arms 38 of the two staples previously impaled into that sack forming the apron section. In similar manner, a sack 26 to form the lowermost row of the apron section may be then be impaled onto the one exposed arm 38, whereas an adjacent sack for the upper row of the apron section may then be impaled onto the exposed arm of the remaining staple 34.

In this way, the apron section 24 is formed as a contiguous flexible apron structure which can move to accommodate ground movement as well as underscouring. The apron structure 24 will therefore settle to follow the contours of the bed 40 as underscouring occurs during use until it has settled to the extent where scouring is no longer significant. Because the staples 34 are used in an inverted condition, they can flex much more easily to accommodate downward deflection of the sacks in the skirt section as a result of underscouring.

Figure 2:
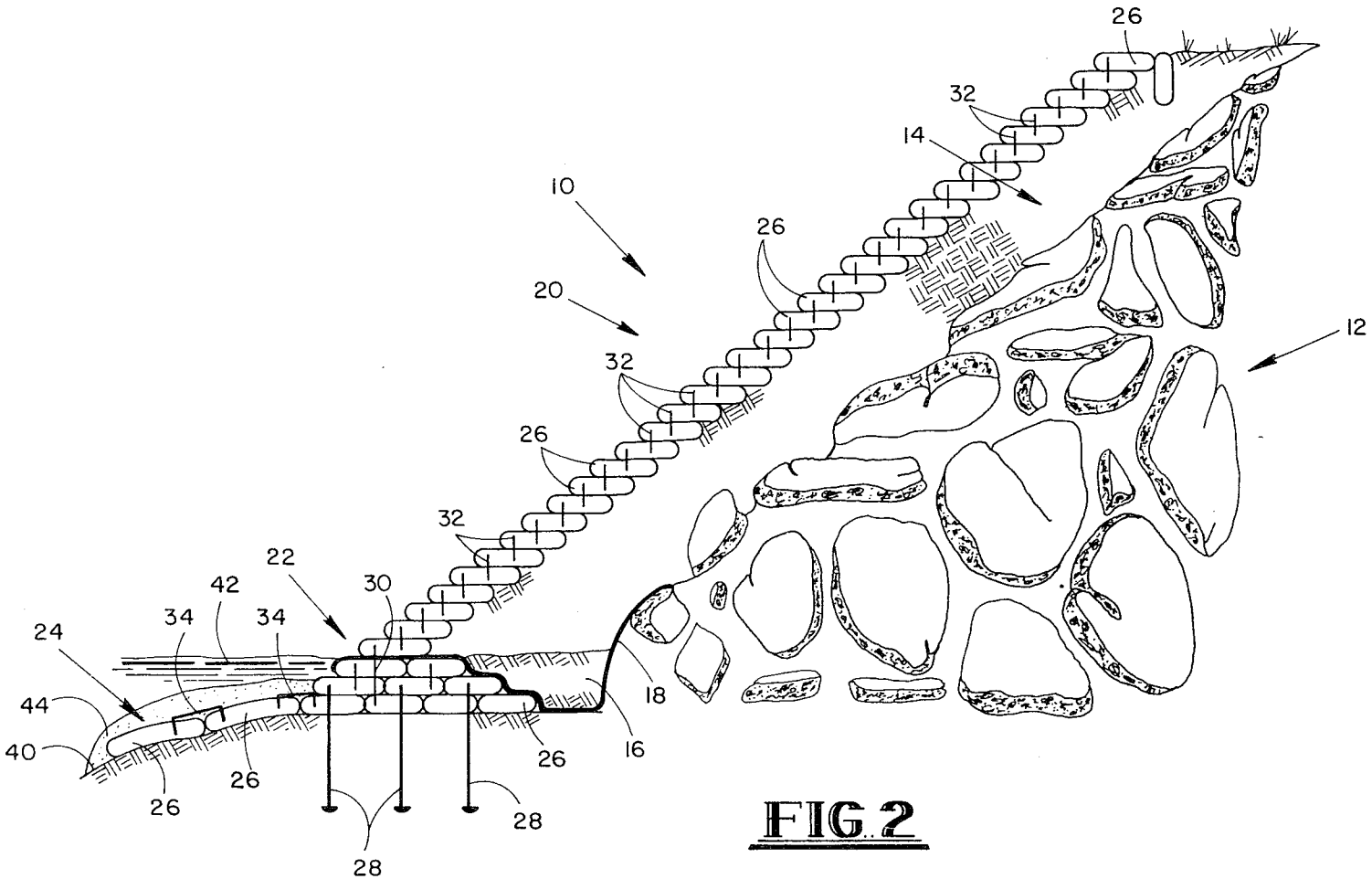
FIG. 2 shows a view similar to that of FIG. 1, of an alternative embodiment.

In the embodiment illustrated in FIG. 2 of the drawings, the staples 34 have been used in a non-inverted position. In addition, staples have not been used to connect adjacent sacks 26 in the same row of the skirt section 24 together. Each two interconnected sacks in the two rows can therefore move freely relatively to the two interconnected sacks on either side thereof. Otherwise the structure 10 of FIG. 2 corresponds with the structure 10 of FIG. 1.

Once the apron or skirt sections 24 have been formed, they can be covered with loose backfill 44.

It is an advantage of the embodiments of the invention as illustrated in the drawings, that the staples 34 can be made out of standard materials to yield under appropriate loads for the yield strength of the concrete and the weight of the sacks 26. It is a further advantage that the staples 34 can readily be inserted into the sacks 26 before hydration. Once the concrete in the sacks 26 has set, the staples 34 will be firmly located against withdrawal, and can then bend when soil movement or erosion occurs for the structure 10, and particularly for the apron or skirt section 24 to accommodate such movement and follow the contours. The staples 34 can therefore connect the sacks 26 together to form a cohesive articulated structure. The staples 34 can be inserted in position by simply impaling the arms 38 into the sack without any burdensome specific location of reinforcing being necessary and without the need to connect the reinforcing previously positioned in the sacks 26 by means of wires, ropes or the like.

Because the arms 38 of the staples 34 extend transversely to the major planes of the sacks 26, they will be more resistant to withdrawal out of the sacks 26 during use.

What is claimed is:

1. A protection structure for protecting the base of a bank structure against underscouring by water action, the protection structure comprising:

(a) a plurality of sacks of cementitions material which are positioned in side-by-side relationship in a layer which rests on a bed surface adjacent the base of the bank structure to form a protective skirt which extends from the base of the bank structure;

(b) a plurality of staples, each staple comprising a base portion and a pair of arms which extend transversely to the base portion from opposed ends of the base portion;

(c) the staples having their arms impaled into adjacent sacks of the layer forming the protective skirt so that the staples connect such adjacent sacks together with the base portions of the staples extending between such adjacent sacks;

(d) the staples being resiliently deformable so that the sacks of the protective skirt can move relatively to each other through deformation of the deformable staples to allow the protective skirt to be capable of articulation so that it can settle to accommodate underscouring during use; and (e) the protective skirt being connected to the bank structure.

2. A structure according to claim 1, in which the protective skirt is connected to the bank structure by means of the staples.

3. A structure according to claim 1, in which the protective skirt comprises a plurality of adjacent rows of sacks which rest in a layer on the bed surface and extend from the base of the bank structure, and in which the sacks in such adjacent rows are connected together by means of the staples which allow the sacks in the adjacent rows to move relatively to each other.

4. A structure according to claim 1, in which the bank structure is a structure built up against the bank out of a plurality of sacks of cementitious material which are stacked on top of each other.

5. A structure according to claim 1, in which the staples are sufficiently resiliently deformable to be capable of deformation under the weight of one of the sacks when partly unsupported to allow the protective skirt to readily follow the contours of the bed as underscouring occurs during use.

6. A structure according to any one of claim 1, in which the staples are upside down for the arms of the staples to extend upwardly into the sacks.

7. A structure according to any one of claim 1, in which the arms of the staples are ribbed to provide resistance to withdrawal of the arms from the set cementitious material during use.

8. A method of forming a protective structure for protecting the base of a bank structure against underscouring by water action, the method comprising:

(a) laying a plurality of sacks of cementitious material in side-by-side relationship in a single layer in at least one row on a bed surface adjacent the base of the bank structure to extend from the base of the bank structure;

(b) connecting adjacent sacks of the layer together by impaling the arms of staples into such adjacent sacks, each staple comprising a base portion and a pair of arms extending from opposed ends of the base portion so that the base portions of the staples extend between adjacent sacks;

(c) connecting the layer of sacks on the bed surface to the base of the bank structure by means of further staples;

(d) the staples being resiliently deformable to allow the sacks in the layer to be able to move relatively to each other and relatively to the bank structure through deformation of the staples; and (e) allowing the sacks to become hydrated to cause the cementitious material to set and to bind the impaled arms of the staples in position in the sacks thereby forming a protective apron structure which is capable of articulation through deformation of the staples to allow the sacks of the apron to settle to accommodate underscouring during use.

9. A method according to claim 8, in which the sacks are laid in a plurality of adjacent rows in a single layer on the bed surface, and in which the sacks of adjacent rows are connected to each other in the same way by means of staples.

10. A method according to claim 8, in which the staples are inserted into the sacks from underneath.

11. A method according to claim 8, in which the staples are inserted into the sacks from underneath in zones of the apron to facilitate downward deflection of such zones of the apron to accommodate undercutting of the apron.

12. A method according to claim 8, in which the staples are positioned by inserting one arm of a staple into a first sack, locating the first sack in position with the arms of the staple directed upwardly, inserting an arm of a staple into a second sack, turning the second sack over, and impaling the second sack onto the exposed arm of the staple of the first sack, and so on.

* * * * *